US012735247B2

(12) United States Patent
Jöbges

(10) Patent No.: US 12,735,247 B2
(45) Date of Patent: Sep. 15, 2026

(54) BEVERAGE CONTAINER

(71) Applicant: Ardagh Metal Beverage Holdings Germany GmbH, Bonn (DE)

(72) Inventor: Udo Jöbges, Duren (DE)

(73) Assignee: Ardagh Metal Beverage Holdings Germany GmbH, Bonn (DE)

( * ) Notice: Subject to any disclaimer, the term of this patent is extended or adjusted under 35 U.S.C. 154(b) by 156 days.

(21) Appl. No.: 17/053,045

(22) PCT Filed: Mar. 22, 2019

(86) PCT No.: PCT/EP2019/057179
§ 371 (c)(1),
(2) Date: Nov. 4, 2020

(87) PCT Pub. No.: WO2019/211042
PCT Pub. Date: Nov. 7, 2019

(65) Prior Publication Data

US 2021/0237966 A1 Aug. 5, 2021

(30) Foreign Application Priority Data

May 4, 2018 (DE) ..... 102018110764.1

(51) Int. Cl.
*B65D 85/73* (2006.01)

(52) U.S. Cl.
CPC ..... *B65D 85/73* (2013.01)

(58) Field of Classification Search
CPC ..... B65D 85/73
See application file for complete search history.

(56) References Cited

U.S. PATENT DOCUMENTS 2,279,396 A * 4/1942 Hanson, Jr. ..... B65D 77/283 215/388
4,995,218 A * 2/1991 Byrne ..... B65D 85/73 53/410
5,196,216 A * 3/1993 Lynch ..... B65D 85/73 206/221

(Continued)

FOREIGN PATENT DOCUMENTS

CN 1115976 A 1/1996
CN 101948035 A 1/2011

(Continued)

OTHER PUBLICATIONS

Definition of "eccentric." Merriam-Webster's Online Mar. 26, 2016 <https://web.archive.org/web/20160326231921/http://www.merriam-webster.com/dictionary/eccentric> (Year: 2016).*

(Continued)

*Primary Examiner* — Viren A Thakur
(74) *Attorney, Agent, or Firm* — Knobbe, Martens, Olson & Bear, LLP

(57) ABSTRACT

Beverage container, at least comprising a housing having a bottom, a lid and a wall region connecting the bottom to the lid; wherein the beverage container has a first volume which can be partially filled with a liquid; wherein the beverage container further comprises a pressure container having a third volume, said pressure container being arranged in the first volume; wherein the pressure container has at least one opening which connects the first volume and third volume and which has a diameter of less than 0.2 millimetre.

15 Claims, 3 Drawing Sheets

(56) References Cited

U.S. PATENT DOCUMENTS

Figure 1:
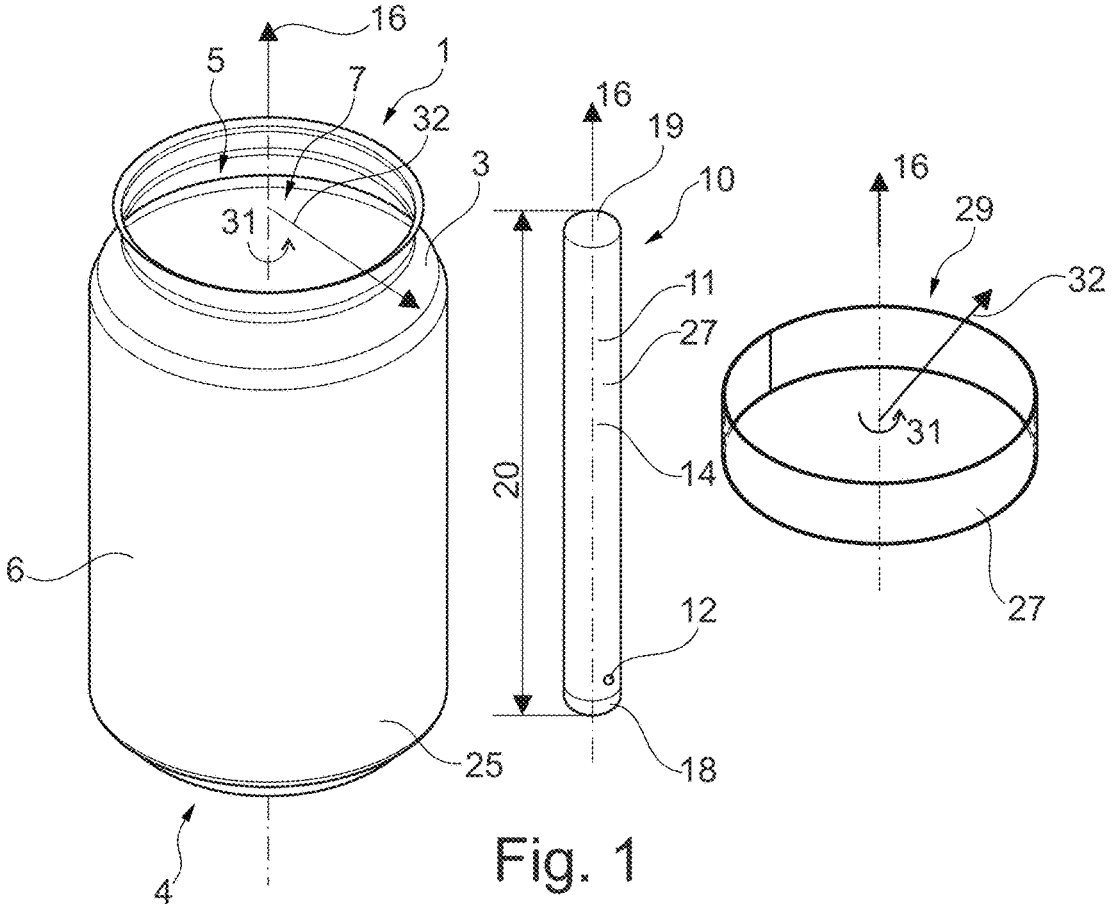

| | | | | | |
|---|---|---|---|---|---|
| 5,203,140 | A * | 4/1993 | Jamieson | B65B 3/04 | 426/115 |
| 5,310,564 | A * | 5/1994 | Kimm | B65D 77/08 | 206/217 |
| 5,335,813 | A * | 8/1994 | Qi | B65D 81/3216 | D9/438 |
| 5,552,168 | A * | 9/1996 | Cameron-Price | B65D 85/73 | 426/106 |
| 5,584,165 | A | 12/1996 | Wright | | |
| 5,609,038 | A * | 3/1997 | Halimi | B65D 85/73 | 62/294 |
| 5,660,867 | A * | 8/1997 | Reynolds | B65D 85/73 | 206/222 |
| 5,670,194 | A * | 9/1997 | Fuller | B65D 85/73 | 426/112 |
| 5,683,732 | A | 11/1997 | Baxter | | |
| 5,780,083 | A | 7/1998 | Wright et al. | | |
| 6,142,326 | A * | 11/2000 | Cornell | B65D 71/066 | 215/388 |
| 6,230,913 | B1 * | 5/2001 | Cornell | B65D 77/283 | 215/40 |
| 7,299,936 | B2 * | 11/2007 | Singh | B65D 81/3227 | 206/499 |
| 7,802,678 | B2 * | 9/2010 | Juneau | B65D 81/3222 | 222/82 |
| 9,114,910 | B1 * | 8/2015 | Schommer | B65D 77/0493 | |
| 2002/0017082 | A1 * | 2/2002 | Cornell | B65D 85/73 | 53/474 |
| 2005/0173271 | A1 | 8/2005 | Levi | | |
| 2006/0102581 | A1 * | 5/2006 | Yates | B65D 81/3216 | 215/6 |
| 2011/0183057 | A1 | 7/2011 | Jones | | |
| 2011/0192734 | A1 * | 8/2011 | Helou, Jr. | B65D 81/3222 | 206/219 |

FOREIGN PATENT DOCUMENTS

| | | | | | |
|---|---|---|---|---|---|
| CN | 102442484 | A * | 5/2012 | B65D 81/3216 | |
| CN | 106458557 | A | 2/2017 | | |
| EP | 0227213 | | 7/1987 | | |
| EP | 0520602 81 | | 12/1992 | | |
| EP | 0597606 | A1 | 5/1994 | | |
| EP | 0643662 | B1 | 3/1995 | | |
| EP | 0835840 | A1 * | 4/1998 | B67B 3/02 | |
| FR | 2293375 | A2 * | 7/1976 | | |
| GB | 2273917 | A * | 7/1994 | B65D 85/73 | |
| GB | 2332413 | A * | 6/1999 | B65D 85/73 | |
| JP | S61-217352 | * | 9/1986 | | |
| JP | H5-507455 | | 10/1993 | | |
| JP | H6-211244 | | 8/1994 | | |
| JP | H6-211247 | | 8/1994 | | |
| JP | 2000-516893 | | 12/2000 | | |
| JP | 2018039538 | A * | 3/2018 | | |
| WO | WO 91/07326 | | 5/1991 | | |
| WO | WO 9500416 | | 1/1995 | | |
| WO | WO-9722538 | A1 * | 6/1997 | B65D 85/73 | |
| WO | WO 9810999 | | 3/1998 | | |
| WO | WO-2005081732 | A2 * | 9/2005 | B65D 51/2821 | |
| WO | WO-2018198024 | A1 * | 11/2018 | B65D 25/02 | |

OTHER PUBLICATIONS

Definition of "along." Merriam-Webster's Online. Jun. 2, 2017. <https://web.archive.org/web/20170602125315/https://www.merriam-webster.com/dictionary/along> (Year: 2017).*

May 4, 2018 Written Opinion and International Search Report from PCT/EP2019/057179 (16 pgs).

Jun. 13, 2023, Notification of Reasons for Rejection; Application No. 2020-563496; English Translation; 4 pages.

* cited by examiner

BEVERAGE CONTAINER

CROSS REFERENCE TO RELATED APPLICATIONS

This application is the U.S. National Phase Application under 35 U.S.C. § 371 of International Application No. PCT/EP2019/057179, filed Mar. 22, 2019, which claims priority to German Application No. 102018110764.1, filed on May 4, 2018, the entire disclosures of each of which are hereby incorporated by reference.

The present invention relates to a beverage container, in particular a (metallic) beverage can. The beverage container serves for storing a content, for example a liquid, wherein, in the closed state (starting state), the beverage container is under a positive pressure with respect to the surroundings or with respect to atmospheric pressure of approximately 1 bar.

It is precisely the case in beverage cans having a carbonized content that the beverage container, prior to the first opening, can be under an internal pressure of up to 6.2 bar.

EP 0 227 213 A2 discloses a beverage container in which a pressure container (widget) is arranged inside the beverage container. A gas is stored here in the pressure container that, upon opening of the beverage container, exits an opening in the container and causes the liquid stored in the beverage container to foam. It is generally the case that the gas comprises an inert gas and possibly additionally carbon dioxide. The inert gas is nitrogen, for example. The pressure container is arranged in a bottom region of the beverage container such that the gas exiting the pressure container into the liquid induces foaming in as large a volume of the liquid as possible. For this purpose, the pressure container is arranged completely submerged in the liquid. An opening in the container having a diameter of at least 0.2 millimetre is described.

The pressure container reduces the volume provided in the beverage container for the liquid.

There exists a constant need to improve such beverage containers and to arrange for the liquid to foam as uniformly and consistently as possible.

It is therefore an object of the invention to at least partially solve the existing problems in the prior art and in particular to provide a beverage container in which it is possible to realize as uniform and consistent foaming of the liquid as possible or a stable foam. It is intended at the same time for the volume available in the beverage container for the liquid to be utilized as efficiently as possible.

These objects are achieved by a beverage container according to the features of claim 1. Further advantageous embodiments of the beverage containers are specified in the dependent claims. It should be noted that the features listed individually in the dependent claims can be combined with one another in a technologically appropriate manner and define further embodiments of the invention. Moreover, the features given in the claims are more fully specified and explained in the description, wherein further preferred embodiments of the invention are presented.

A (metallic) beverage container is proposed, at least comprising a housing (which is sealed in a starting state) having a bottom, a lid and a (cylindrical) wall region connecting the bottom to the lid. The beverage container has a first volume which can be partially filled (or is filled in the starting state) with (a second volume of) a liquid. The beverage container further comprises a pressure container having a third volume, said pressure container being arranged in the first volume, wherein, the pressure container has at least one opening which connects the first volume and the third volume and which has a diameter of less than 0.2 millimetre, in particular of less than 0.18 millimetre, preferably of less than 0.15 millimetre, particularly preferably of less than 0.12 millimetre, very particularly preferably of 0.1 millimetre or less (in particular at least 0.05 millimetre); and/or the first volume has a largest height between the bottom and the lid along an axial direction, wherein the pressure container has, between a first end and a second end, a length along the axial direction that is at least 50%, in particular at least 75%, preferably at least 85%, of the largest height.

In the starting state, the beverage container is in particular under a first pressure which is greater than a second pressure of the surroundings (the second pressure is in particular at most 1.1 bar, with the second pressure preferably being at least 2.5 bar). As long as the beverage container is in the starting state, the pressure of the volumes (first volume, second volume, third volume) is in particular equal in each case.

In the starting state, the pressure container is at least partially filled with a gas (possibly additionally partially with the liquid). When the beverage container is opened and there is pressure equalization with the surroundings, at least the gas (and possibly also the liquid) exits the third volume into the liquid via the at least one opening.

The beverage container is in particular a beverage can.

In an upright state of the beverage container, the bottom is at the bottom and the lid at the top with respect to the direction of gravitational force. In particular, the wall region extends between the bottom and lid along an axial direction (substantially) parallel to the direction of gravitational force (with the beverage container standing upright) and, in a circumferential direction, fully circumferentially around the bottom and lid.

The first volume is in particular between 0.1 and 5 litres, preferably at most 3 litres, particularly preferably at most 1.5 litres.

The second volume is in particular between 1% and 10%, preferably between 1% and 5%, less than the first volume.

The third volume is in particular between 1% and 5%, preferably between 1% and 3%, of the first volume.

In particular, a sum of the second volume and third volume is at least 1% less than the first volume.

The opening of the beverage container is as a rule effected via an actuatable opening in the lid. In particular, the opening is not reclosable, or the positive pressure prevailing in the starting state cannot be re-established by reclosing the opening.

It has been shown surprisingly that the foam formation can be considerably improved by means of the relatively small opening. In particular, the gas situated in the pressure container exits over a relatively long time period such that more uniform foam formation can be observed. Furthermore, the bubble formation in the liquid can be influenced such that an overall more homogeneous and also more stable foam can be generated. It has emerged in particular that, by virtue of the better foam formation, the third volume can be further reduced. A smaller amount of gas is required in the pressure container to achieve the foam formation required hitherto. Correspondingly, the second volume can be increased and the third volume decreased such that more liquid can be stored in the beverage container.

The pressure container can have a plurality of openings. In particular, all the openings have a diameter of less than 0.2 millimetre, in particular of less than 0.18 millimetre, preferably of less than 0.15 millimetre, particularly preferably of less than 0.12 millimetre, very particularly preferably of 0.1 millimetre or less (in particular at least 0.05 millimetre). The provision of a plurality of openings can effectively influence the foam formation. It is thus possible in particular to stimulate a relatively large sub-volume of the liquid, that is to say of the second volume.

In particular, with a beverage container standing upright, at least two of the plurality of openings are arranged at mutually different height positions.

The beverage container extends in particular from the bottom towards the lid along an axial direction. The axial direction preferably runs parallel to the wall region. In particular, the beverage container is of substantially cylindrical configuration and has (apart from structures for example in the lid, for example for opening/closing the first volume) an axis of rotation or axis of symmetry which extends parallel to the axial direction.

The height extends in particular along the axial direction, starting from a lowest point of the first volume in the region of the bottom towards a highest point in the region of the lid. The distance between the lowest point and the highest point, measured along the axial direction, is referred to as the largest height. A value of the height at which for example an opening is situated is referred to as the height position.

In particular, with a beverage container standing upright, at least two of the plurality of openings are arranged at an identical height position of the height.

The first volume has a largest height in particular between the bottom and the lid along an axial direction, wherein the pressure container has, between a first end and a second end, a length along the axial direction that is at least 50%, in particular at least 75%, preferably at least 85%, of the largest height.

With particular preference, the length is at least 90% or even at least 95% of the largest height.

According to another embodiment, the length is 98% or even almost 100% (for example at least 99.5%) of the largest height.

In particular, with a beverage container standing upright, the third volume of the pressure container extends up and into an upper region adjacent to the lid, wherein the upper region is situated above a predetermined filling level of the liquid.

By virtue of the third volume projecting into the upper region, it is possible for the second volume to be further increased with respect to the first volume.

In particular, with a beverage container standing upright, the first volume has at least one lowest point. The third volume of the pressure container extends down and into a lower region adjacent to the bottom such that the at least one opening is arranged at most 10 millimetres, in particular at most 8 millimetres, preferably at most 6 millimetres, particularly preferably at most 4 millimetres, away from the lowest point. In particular, a small distance from the lowest point is required, which is predetermined at least by a wall thickness of the pressure container.

The hitherto known gas-filled pressure containers in beverage containers have been arranged as a rule so as to be centred with respect to the bottom and with respect to the wall region. Here, these pressure containers have been arranged in abutment against the bottom, which is (routinely) curved into the first volume, and fastened thereto possibly by way of an adhesive. The arrangement on the curved bottom leads inevitably to the fact that an opening in the pressure container is arranged at a relatively large distance from a lowest point of a first volume. This has meant hitherto, however, that just a relatively small sub-volume of a liquid stored in the beverage container was able to be stimulated for foam formation.

However, the presently proposed pressure container extending along the height is able, by virtue of its relatively small extent in a radial direction, also to be arranged eccentrically with respect to the bottom or with respect to the first volume. It is thus possible for the pressure container to be arranged in particular (directly) adjacent to the wall region and to extend into the core bevels of the beverage container (the lowest edge of the beverage container that routinely extends around the curved bottom).

The arrangement of the at least one opening at a small distance from the lowest point makes it possible, as a result of at least the gas flowing out of the pressure container, for a relatively large sub-volume of the second volume to be stimulated.

In particular, the pressure container extends into both core bevels of the beverage container such that it is fixed in its position at least with respect to a radial direction by way of the core bevels (that is to say extending into both core bevels).

In particular, the pressure container, at least at one end, preferably at both ends, can be (in particular exclusively) elastically deformed by the beverage container (preferably by the core bevel or by both core bevels), with the result that the pressure container is fixed in its position in the core bevels and in the first volume also with respect to a circumferential direction.

In particular, the pressure container is arranged (directly) adjacent to a wall (for example the bottom, the lid or the wall region) of the beverage container at least with the first end or with the second end such that, at least with respect to an axial direction, an abutment is formed between the end and the wall. In particular, the pressure container is arranged with respect to the wall in such a way that a further displacement of the pressure container along the axial direction forces at least one displacement of the wall-contacting end of the pressure container in the radial direction or in the circumferential direction. In this context, adjacent means in particular that the end is arranged at a distance of at most 2 millimetres from the wall. Directly adjacent then means that the end contacts the wall.

In particular, both ends are arranged (directly) adjacent to a wall in each case such that a further movement of the pressure container along the axial direction is at least restricted.

It is thus possible in particular to prevent the pressure container from being released and noise being generated as a result of a movement of the pressure container with respect to the beverage container.

In particular, the pressure container has at least partially (preferably completely) a cylindrical shape along the axial direction (between the first end and the second end), wherein a diameter of the cylindrical shape is at most 20 millimetres, preferably at most 15 millimetres, particularly preferably at most 13 millimetres. In particular, the diameter is at least 5 millimetres, preferably at least 10 millimetres.

The pressure container has in particular a wall thickness of at most 0.4 millimetre, preferably of at most 0.3 millimetre, particularly preferably of at most 0.25 millimetre.

The material used for the pressure container comprises in particular a plastic, in particular PP (polypropylene). In particular, the pressure container is produced from a different material than the housing.

In particular, the pressure container is produced from a (cylindrical) tube (for example in the manner of a straw or of a drinking straw) which in particular has open ends on both sides in the starting state. To produce the pressure container, the tube is cut to the required length and then or at the same time the ends of the cut-to-length tube are closed. Finally, the at least one opening is formed.

In particular, the opening is pierced, that is to say punctured, for example using a needle. To form an opening having a diameter of 0.1 millimetre, it is possible for example for a needle having a diameter of 0.14 millimetre to be used. The smaller diameter of the opening results from the partially elastic deformation of the container material during the puncturing operation.

The puncture of the openings can in particular also be carried out in a reproducible manner for the large piece numbers required.

By comparison with the known containers produced by injection-moulding whose openings are then formed by punching processes, puncturing allows relatively small openings to be produced in a reproducible manner.

In particular, the pressure container having the third volume is arranged directly adjacent to the wall region.

The pressure container can be fixed in a position in the first volume exclusively in a force-fitting manner. In particular, the fastening of the container to the beverage container does not require the use of an adhesive. There is therefore no need to use a food-safe adhesive which also represents a cost factor in the production of the beverage container.

Alternatively, the pressure container can also be connected to a wall (in particular to the wall region) of the beverage container in an integrally bonded manner by using an adhesive.

Alternatively, the pressure container can be connected to a wall (n particular to the wall region) of the beverage container by using an adhesive, wherein the pressure container is additionally fixed in its position at least with respect to a radial direction, for example by extending into the core bevels of the beverage container, or is even fixed in its position in a force-fitting manner (for example as a result of an at least elastic deformation or by means of a retaining element).

The pressure container is preferably fixed in the position in the first volume by way of an elastically deformable retaining element. The retaining element, for example a film strip, is connected to the pressure container before being arranged in the beverage container with the pressure container (for example by means of ultrasonic welding, adhesive bonding, integral forming or the like). The retaining element is in particular introduced into the beverage container in a deformed state, with it elastically deforming there preferably automatically. In particular, the retaining element places itself against a wall, preferably the wall region, of the beverage container and fixes the pressure container by way of a further present pretensioning of the retaining element. The pretensioning particularly causes the retaining element to be connected to the beverage container in a force-fitting manner.

The filling of the beverage container and of the pressure container can be carried out in a known manner, for example as follows:

providing the housing without lid;

providing the pressure container with opening, where appropriate with retaining element;

arranging the pressure container in the housing; where appropriate by way of the retaining element or for example by using an adhesive;

filling the housing with the liquid (second volume);

filling the housing (starting from the second volume in particular up at most to the first volume) for example with inert gas (where appropriate at least partially liquefied);

(gas-tight) closing of the housing with the lid and forming the beverage container;

turning over the beverage container such that the bottom points upwards (relative to the direction of gravitational force) and such that the at least one opening is arranged above the filling level of the first volume with the liquid;

filling the pressure container via the opening with the inert gas, which expands in the closed beverage container as a result of heating;

providing the beverage container in a starting state.

A pressure container for arranging in the already-described beverage container is proposed, wherein the pressure container has at least one opening which has a diameter of less than 0.2 millimetre.

In particular, the pressure container additionally has an elastically deformable retaining element which extends outside of the third volume and which has a configuration which allows the retaining element to be arranged on a wall of the beverage container provided for the pressure container under pretensioning.

The statements made in relation to the beverage container equally apply to the pressure container, and vice versa.

As a precaution, it should be mentioned that the ordinals used here ("first", "second", "third", . . . ) serve primarily (merely) to distinguish a number of similar objects, variables or processes, that is to say, in particular, do not necessarily specify any dependence and/or sequence of these objects, variables or processes. If any dependence and/or sequence is required, this is specified explicitly here or it is obvious to a person skilled in the art in studying the embodiment specifically described.

Figure 2:
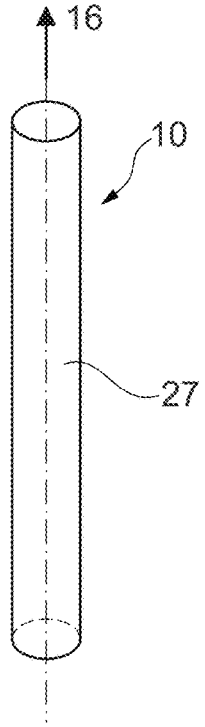
Figure 3:
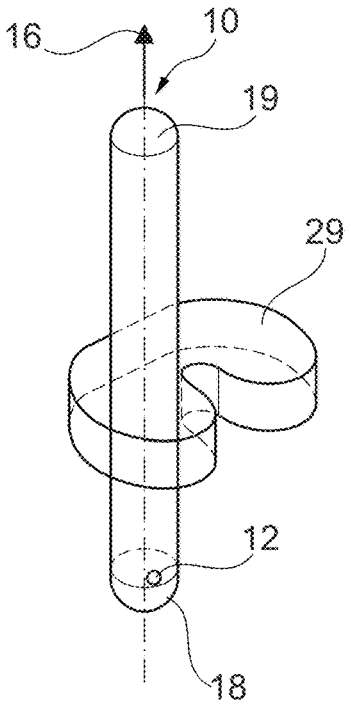
Figure 4:
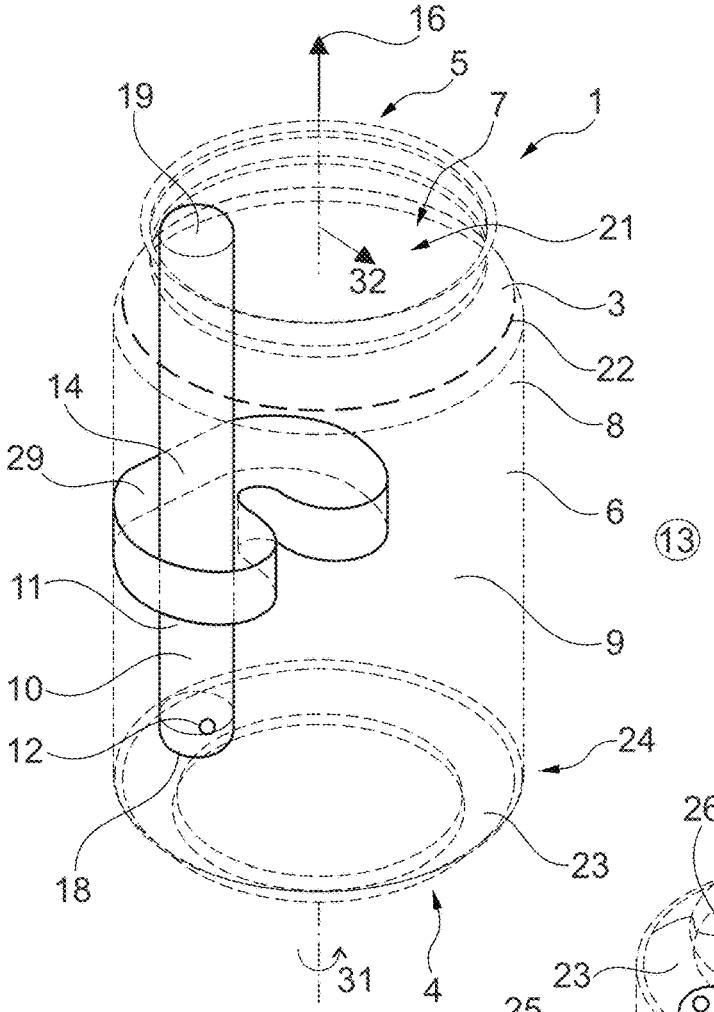
Figure 5:
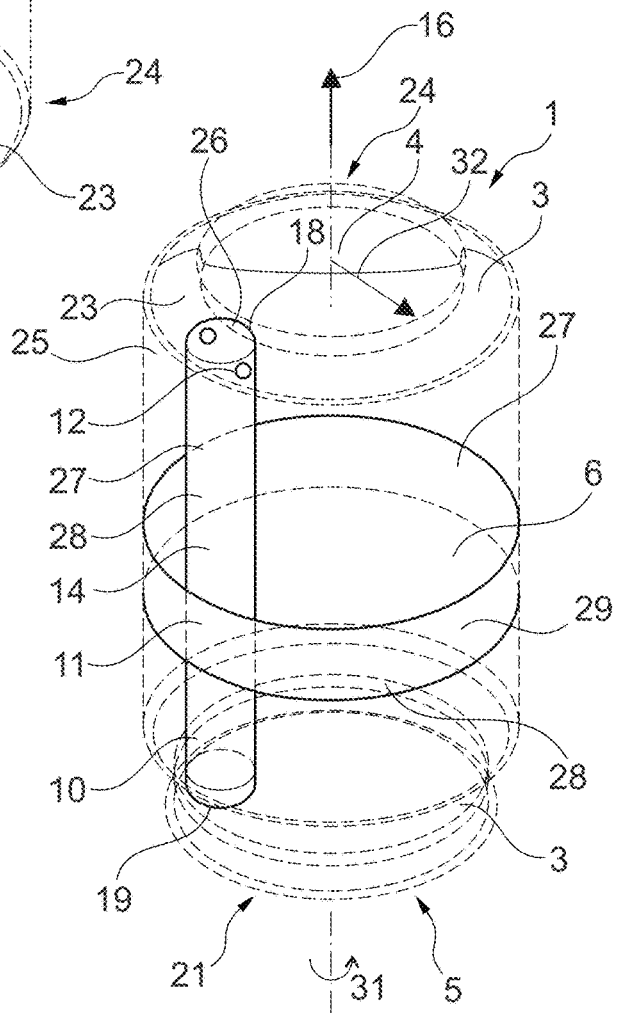
Figure 6:
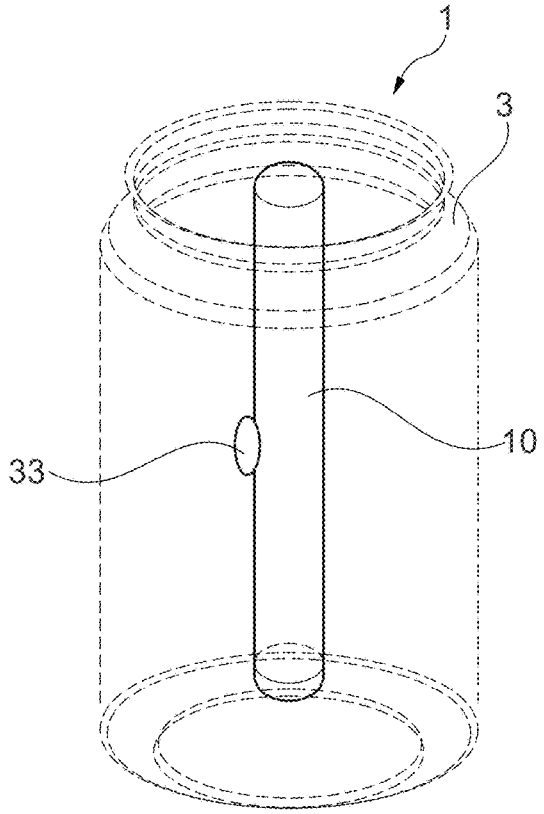
Figure 7:
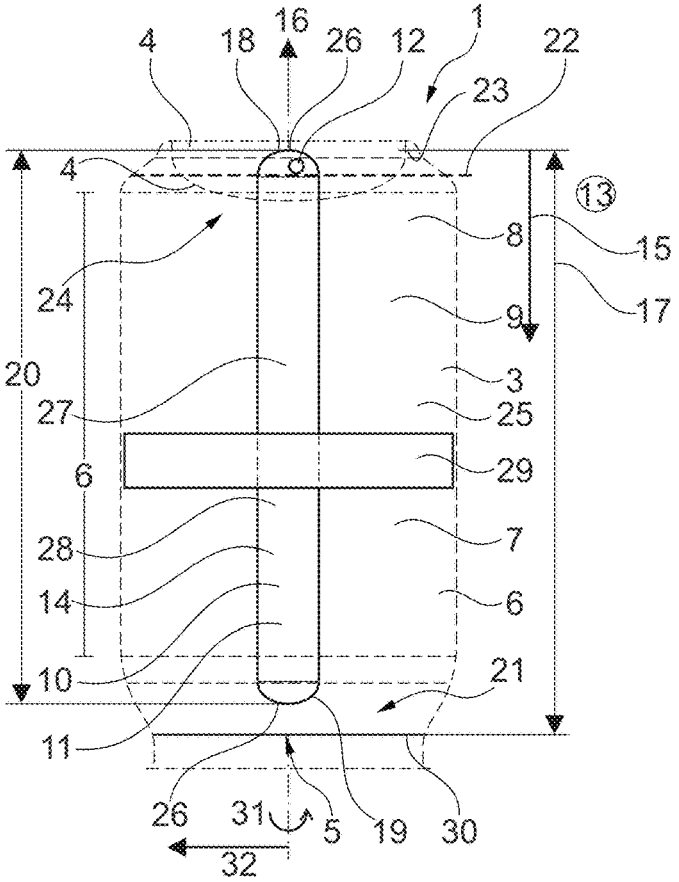

The invention and the technical field are explained in greater detail below by way of the figures. It should be noted that there is no intention to restrict the invention by the exemplary embodiments shown. In particular, unless explicitly stated otherwise, it is also possible to isolate partial aspects of the situations explained in the figures and to combine them with other components and insights from the present description and/or figures. Identical reference signs denote identical objects, and therefore supplementary explanations from different figures can be drawn upon if appropriate. In the drawing:

FIG. 1 schematically shows a beverage container without lid, a pressure container and a retaining element, in each case in a perspective view;

FIG. 2 schematically shows a tube for producing a pressure container in a perspective view;

FIG. 3 schematically shows a pressure container with a retaining element in a perspective view;

FIG. 4 schematically shows the beverage container according to FIG. 1 with a pressure container according to FIG. 3 during assembly, in a perspective view;

FIG. 5 schematically shows the beverage container according to FIG. 4 with assembled pressure container, in a perspective view;

FIG. 6 schematically shows a beverage container with a pressure container without retaining element, in a perspective view; and FIG. 7 schematically shows a beverage container in a starting state in a side view.

FIG. 1 shows a beverage container 1 without lid 5, a pressure container 10 and a retaining element 29, in each case in a perspective view.

The beverage container 1 here comprises a housing 3 having a bottom 4 and a cylindrical wall region 6 connecting the bottom 4 to a lid 5 (see FIG. 7). The beverage container 1 has a first volume 7 which is partially filled with a second volume 8 of a liquid 9.

The beverage container 1 extends from the bottom 4 towards the lid 5 along an axial direction 16. The axial direction 16 runs parallel to the cylindrical wall region 6. The beverage container 1 is of substantially cylindrical configuration and has (apart from structures for example in the lid, for example for opening/closing the first volume 7) an axis of rotation or axis of symmetry which extends parallel to the axial direction 16.

The pressure container 10 extends from a first end 18 along the axial direction 16 towards a second end 19 over a length 20. The pressure container 10 has a (round) opening 12 which has a diameter of less than 0.2 millimetre.

The pressure container 10 has at least partially a cylindrical shape 27 along the axial direction 16 between the first end 18 and the second end 19, wherein a diameter of the cylindrical shape 27 is at most 20 millimetres.

In addition, an elastically deformable retaining element 29 is provided which extends outside of the third volume 11 of the pressure container 10 and has a configuration which allows the retaining element 29 to be arranged on a wall 25 of the beverage container 1 provided for the pressure container 10 under pretensioning.

FIG. 2 shows a tube for producing a pressure container 10 in a perspective view. The pressure container 10 can be produced from the cylindrical tube (for example in the manner of a straw or of a drinking straw) which has an open end on both sides in the starting state. To produce the pressure container 10, the tube is cut to the required length and then or at the same time the ends of the cut-to-length tube are closed. Finally, or else before cutting to length, the opening 12 is formed.

FIG. 3 shows a pressure container 10 with a retaining element 29 in a perspective view. The retaining element 29, for example a film strip, is connected to the pressure container 10 before being arranged in the beverage container 1 (for example by means of ultrasonic welding, adhesive bonding, integral forming or the like). The retaining element 29 is introduced into the beverage container 1 in the elastically deformed state illustrated, with it elastically deforming there preferably automatically.

FIG. 4 shows the beverage container 1 according to FIG. 1 with a pressure container 10 according to FIG. 3 during assembly, in a perspective view. The retaining element 29 is introduced into the beverage container 1 in the elastically deformed state illustrated, with it elastically deforming there preferably automatically (see FIG. 5).

FIG. 5 shows the beverage container 1 according to FIG. 4 with assembled pressure container 10, in a perspective view. The retaining element 29 places itself against a wall 25, here the wall region 6, of the beverage container 1 and fixes the pressure container 10 by way of a further present pretensioning of the retaining element 29. The pretensioning causes the retaining element 29 to be connected to the beverage container 1 in a force-fitting manner. The pressure container 10 is fixed in the position 28 in the first volume 7 by way of the elastically deformable retaining element 29.

FIG. 6 shows a beverage container 1 with a pressure container 10 without retaining element 29, in a perspective view. The pressure container 10 is here fixed in the position 28 on the wall region 6 by means of an adhesive 33.

FIG. 7 shows a beverage container 1 in a starting state 2 in a side view. In the starting state 2, the beverage container 1 has a sealed housing 3 having a bottom 4, a lid 5 and a (cylindrical) wall region 6 connecting the bottom 4 to the lid 5. The beverage container 1 has a first volume 7 which is partially filled with a second volume 8 of a liquid 9. The beverage container 1 further comprises a container 10 having a third volume 11, said container being arranged in the first volume 7. The pressure container 10 has an opening 12. In the starting state 2, the beverage container 1 is under a first pressure which is greater than a second pressure of the surroundings 13. In the starting state 2, the pressure container 10 is at least partially filled with a gas 14 (possibly additionally partially with the liquid 9). When the beverage container 1 is opened and there is pressure equalization with the surroundings 13, at least the gas 14 (and possibly also the liquid 9) exits the third volume 11 via the opening 12 into the liquid 9.

With the beverage container 1 in an upright state (the beverage container 1 is illustrated here standing on the lid 5), the bottom 4 is at the bottom and the lid 5 at the top with respect to the direction of gravitational force. The wall region 6 between the bottom 4 and lid 5 extends along an axial direction 16 parallel to the direction of gravitational force (with the beverage container 1 standing upright) and, in a circumferential direction 31, fully circumferentially around the bottom 4 and the lid 5.

A height 15 extends along the axial direction 16, starting from a lowest point 23 (in particular, as illustrated, arranged in a core bevel of the beverage container 1) of the first volume 7 in the region of the bottom 4 towards a highest point 30 (in particular arranged in a core bevel of the beverage container 1) in the region of the lid 5. The distance between the lowest point 23 and the highest point 30, measured along the axial direction 16, is referred to as the largest height 17. The opening 12 is arranged at a height position of the height 15, that is to say at a certain value of the height.

With the beverage container 1 standing upright as illustrated (standing upside down), the third volume 11 of the pressure container 10 extends up and into a lower region 24 adjacent to the bottom 4, with the lower region 24 being situated above a filling level 22 of the liquid 9.

The third volume 11 of the pressure container 10 extends up and into a lower region 24 adjacent to the bottom 4, with the result that the one opening 12 is arranged at most 5 millimetres away from the lowest point 23 along the axial direction 16.

The presently proposed pressure container 10 extending along the height 15 can, by virtue of its relatively small extent in a radial direction 32, be arranged eccentrically with respect to the bottom 4 or with respect to the first volume 7. It is thus possible for the pressure container 10 to be arranged directly adjacent to the wall region 6 and to extend into the (preferably both of the) core bevels of the beverage container 1 (the lowest edge of the beverage container 1 which, as illustrated, extends around the curved bottom 4; the same can be formed at the highest edge of the beverage container 1, that is to say around the lid 5 or around the—here annular—connection between the lid 5 and wall region 6).

The arrangement of the opening 12 at a small distance from the lowest point 23 makes it possible, as a result of at least the gas 14 exiting the pressure container 10, for a relatively large sub-volume of the second volume 8 to be stimulated.

The pressure container 10 is arranged directly adjacent to the wall region 6 with the third volume 11. The pressure container 10 is arranged with the first end 18 and with the second end 19 in each case directly adjacent to a wall 25 (for example the bottom 4, the lid 5 or the wall region 6) of the beverage container 1 such that, with respect to the axial direction 16, an abutment 26 is in each case formed between the end 18, 19 and the wall 25. The pressure container 10 is thus arranged with respect to the wall 25 in such a way that a further displacement of the pressure container 10 along the axial direction 16 forces at least one displacement of the wall 25—contacting end 18, 19 of the pressure container 10 in the radial direction 32 or in the circumferential direction 31.

Consequently, the pressure container 10 can be arranged fixed in its position 28 in the core bevels at least with respect to the radial direction 32.

The filling of the beverage container 1 and of the pressure container 10 can be carried out in a known manner, for example as follows:

- providing the housing 3 without lid 5 (see FIG. 1, on the left);
- providing the pressure container 10 with opening 12, where appropriate with retaining element 29 (see FIG. 3);
- arranging the pressure container 10 in the housing 3; where appropriate by way of the retaining element 29 (see FIGS. 4 and 5) or for example by using an adhesive 33 (see FIG. 6);
- filling the housing 3 with the liquid 9 (second volume 8);
- filling the housing 3 (starting from the second volume 8 up at most to the first volume 7) for example with inert gas 14 (where appropriate at least partially liquefied);
- (gas-tight) closing of the housing 3 with the lid 5 and forming the beverage container 1;
- turning over the beverage container 1 such that the bottom 4 points upwards (relative to the direction of gravitational force) and such that the opening 12 is arranged above the filling level 22 of the first volume 7 with the liquid 9 (see FIG. 7);
- filling the pressure container 10 via the opening 12 with the inert gas 14, which expands in the closed beverage container 1 as a result of heating (see FIG. 7);
- providing the beverage container 1 in a starting state 2 (see FIG. 7).

LIST OF REFERENCE SIGNS

1 Beverage container
2 Starting state
3 Housing
4 Bottom
5 Lid
6 Wall region
7 First volume
8 Second volume
9 Liquid
10 Pressure container
11 Third volume
12 Opening
13 Surroundings
14 Gas
15 Height
16 Axial direction
17 Largest height
18 First end
19 Second end
20 Length
21 Upper region
22 Filling level
23 Lowest point
24 Lower region
25 Wall
26 Abutment
27 Shape
28 Position
29 Retaining element
30 Highest point
31 Circumferential direction
32 Radial direction
33 Adhesive

The invention claimed is:

1. A beverage container, comprising:

a housing comprising a bottom, a lid, and a wall region connecting the bottom to the lid;

wherein the beverage container includes a first volume configured to be at least partially filled with a liquid to a first volume height, the first volume height being between the bottom and the lid along an axial direction;

wherein the beverage container comprises a first core bevel where the wall region contacts the bottom;

wherein the beverage container comprises a second core bevel where the wall region contacts the lid; and a pressure container arranged within the first volume of the beverage container, said pressure container comprising a first end, a second end, and a volume extending from the first end to the second end;

wherein:

the pressure container is arranged adjacent to the wall region such that further movement of the pressure container along the axial direction is restricted by the bottom and the lid;

the first end of the pressure container extends into the first core bevel of the beverage container and the second end of the pressure container extends into the second core bevel of the beverage container such that the pressure container is fixed by the first core bevel and the second core bevel also in a radial direction.

2. The beverage container according to claim 1, wherein the pressure container includes a plurality of openings each having a diameter of less than 0.2 millimetre.

3. The beverage container according to claim 2, wherein, with the beverage container standing upright, at least two of the plurality of openings are arranged at different heights along the pressure container.

4. The beverage container according to claim 2, wherein, with the beverage container standing upright, at least two of the plurality of openings are arranged at an identical height along the pressure container.

5. The beverage container according to claim 1, wherein the pressure container has, at least partially, a cylindrical shape along the axial direction, wherein a diameter of the cylindrical shape is at most 20 millimetres.

6. The beverage container according to claim 1, wherein the pressure container has a wall thickness of at most 0.4 millimetre.

7. The beverage container according to claim 1, wherein the pressure container is fixed in the first volume exclusively by force-fitting the pressure container into the first volume.

8. The beverage container according to claim 1, wherein a position of the pressure container is fixed in the first volume by an elastically deformable retaining element and by force-fitting the pressure container into the first volume.

9. The beverage container of claim 1, wherein the pressure container has at least one opening which has a diameter of less than 0.2 millimetre.

10. The pressure container according to claim 9, wherein the pressure container additionally includes an elastically deformable retaining element which extends outside of the volume and which has a configuration which allows the retaining element to be arranged on a wall of the beverage container for providing the pressure container under pretensioning.

11. The beverage container according to claim 1, further comprising at least one opening which connects the first volume and volume, and the at least one opening has a diameter of less than 0.2 millimetre.

12. The beverage container according to claim 9, wherein, with the beverage container standing upright, the first volume has a lowest point; wherein the volume of the pressure container extends down and into a lower region adjacent to the bottom such that the at least one opening is arranged at most 5 millimetres away from the lowest point.

13. The beverage container according to claim 1, wherein the pressure container is not integrally formed with the housing.

14. The beverage container according to claim 1, wherein the pressure container is configured such that displacement along the axial direction forces displacement of the first end or the second end of the pressure container in a circumferential direction.

15. The beverage container according to claim 1, wherein the pressure container is arranged entirely adjacent to the wall region.

* * * * *